US007766674B1

(12) United States Patent
Mao et al.

(10) Patent No.: US 7,766,674 B1
(45) Date of Patent: Aug. 3, 2010

(54) ELECTRICAL CONNECTOR WITH HIGH PROFILE

(75) Inventors: Yu-Hua Mao, Kunshan (CN); Zhi-Hong Fang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/490,336

(22) Filed: Jun. 24, 2009

(30) Foreign Application Priority Data

Feb. 9, 2009 (CN) ..... 2009 2 0300526

(51) Int. Cl.
*H01R 12/00* (2006.01)

(52) U.S. Cl. ..... 439/82; 439/751

(58) Field of Classification Search ..... 439/82, 439/78, 83, 84, 571, 751, 876, 943
See application file for complete search history.

(56) References Cited

U.S. PATENT DOCUMENTS

| | | | | |
|---|---|---|---|---|
| 6,425,770 | B1 * | 7/2002 | Lostoski et al. | 439/76.1 |
| 6,634,893 | B1 * | 10/2003 | Korsunsky et al. | 439/82 |
| 6,688,895 | B1 | 2/2004 | Fan | |
| 7,004,792 | B2 | 2/2006 | Shimizu | |
| 7,125,285 | B2 * | 10/2006 | Maejima et al. | 439/82 |
| 7,223,107 | B2 | 5/2007 | Mao | |

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

An electrical connector includes an insulating housing (1*a*) including a pair of retaining spacers (1*b*) embedded therein and a number of terminals (2). The insulating housing has a base portion (11) with a concaving room (110) and an engaging portion (12). The terminal (2) defines a retaining portion (21) retained in the base portion, a contacting portion (22) projecting in the engaging portion and a leg portion (23). The retaining spacers are received in the concaving room and press against the retaining portions of the terminals.

10 Claims, 6 Drawing Sheets

ELECTRICAL CONNECTOR WITH HIGH PROFILE

BACKGROUND OF THE INVENTION

1. Field of the Invention

The present invention relates to a high profile electrical connector.

2. Description of the Related Art

U.S. Pat. No. 6,688,895 issued on Feb. 10, 2004, discloses an electrical connector including a longitudinal insulative housing, a plurality of contacts received in the housing and arranged along a longitudinal direction of the housing and a shielding member covering on the insulative housing for preventing EMI (Electro Magnetic Interference). The housing is provided with a base portion, a mating room surrounding by four side walls extending upwardly from a bottom wall and a tongue portion protruding into the mating room from the bottom wall. The tongue portion defines a plurality of passageways extending downwardly through the bottom wall to receive the contacts.

With development of electronics technology, the distance between two adjacent contacts is required to be smaller and smaller in accordance to decreasing length of the electrical connector or increasing contact number of the electrical connector. That is to say, the rib walls partitioning two adjacent contacts become thinner. So the contacts would interfere with each other when the rib wall breaks under frequent connection and disconnection. The rib walls would also have some disadvantages, such as distortion, crack in molding of the passageways.

Therefore, an improved electrical connector is desired to overcome the disadvantages of the related arts.

SUMMARY OF THE INVENTION

An object of the present invention is to provide an electrical connector having a retaining spacer to retain retaining portions of terminals.

In order to achieve above-mentioned object, an electrical connector in accordance with a preferred embodiment of the present invention includes an insulating housing including a retaining spacers embedded therein and a plurality of terminals. The insulating housing has a base portion with a concaving room and an engaging portion. The terminal defines a retaining portion retained in the base portion, a contacting portion projecting in the engaging portion and a leg portion. The retaining spacer is received in the concaving room and press against the retaining portions of the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
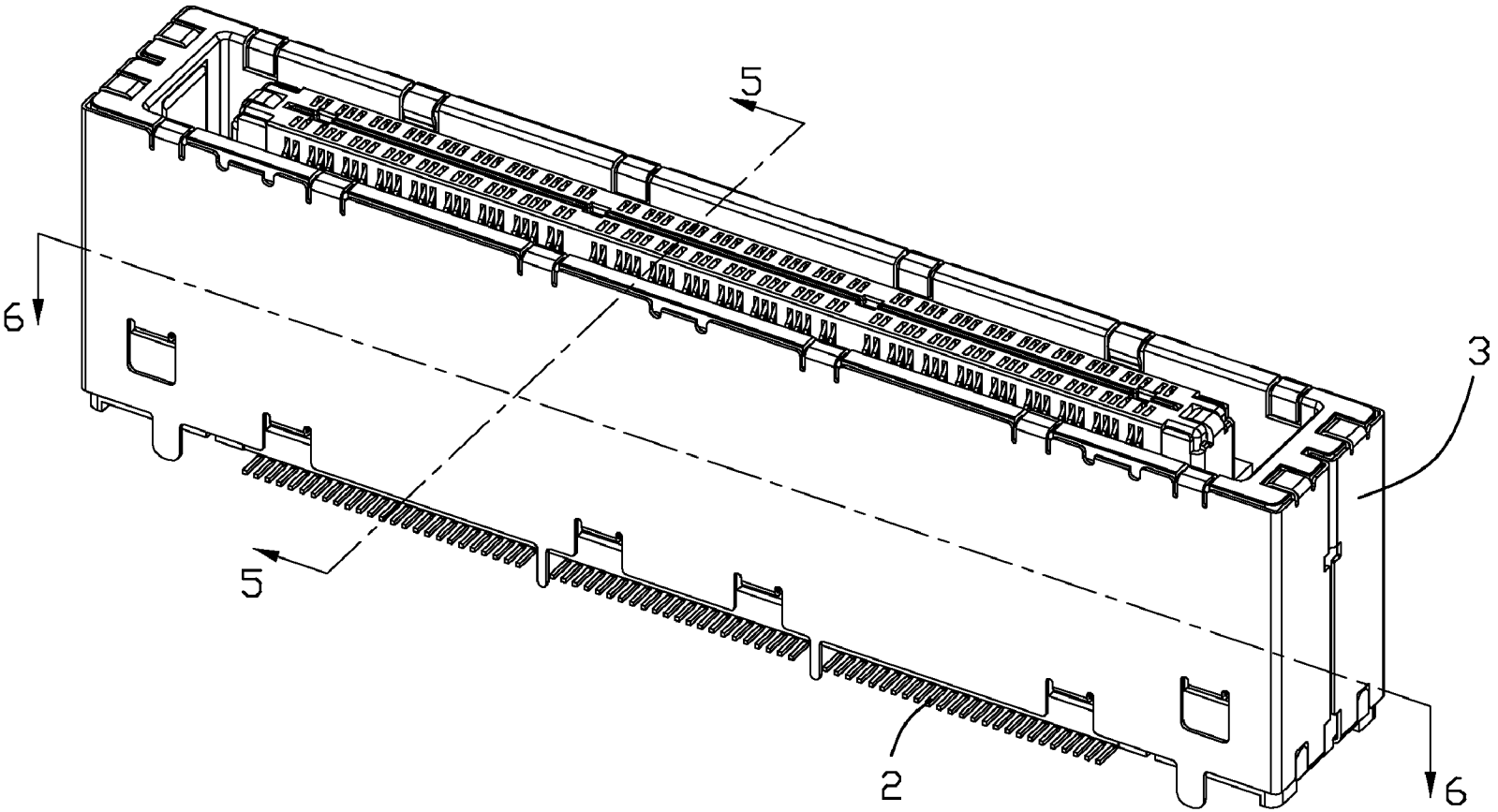
FIG. 1 is a perspective view of an electrical connector in accordance with the preferred embodiment of the present invention.

Reference will now be made to the drawing figures to describe the preferred embodiment of the present invention in detail.

Figure 2:
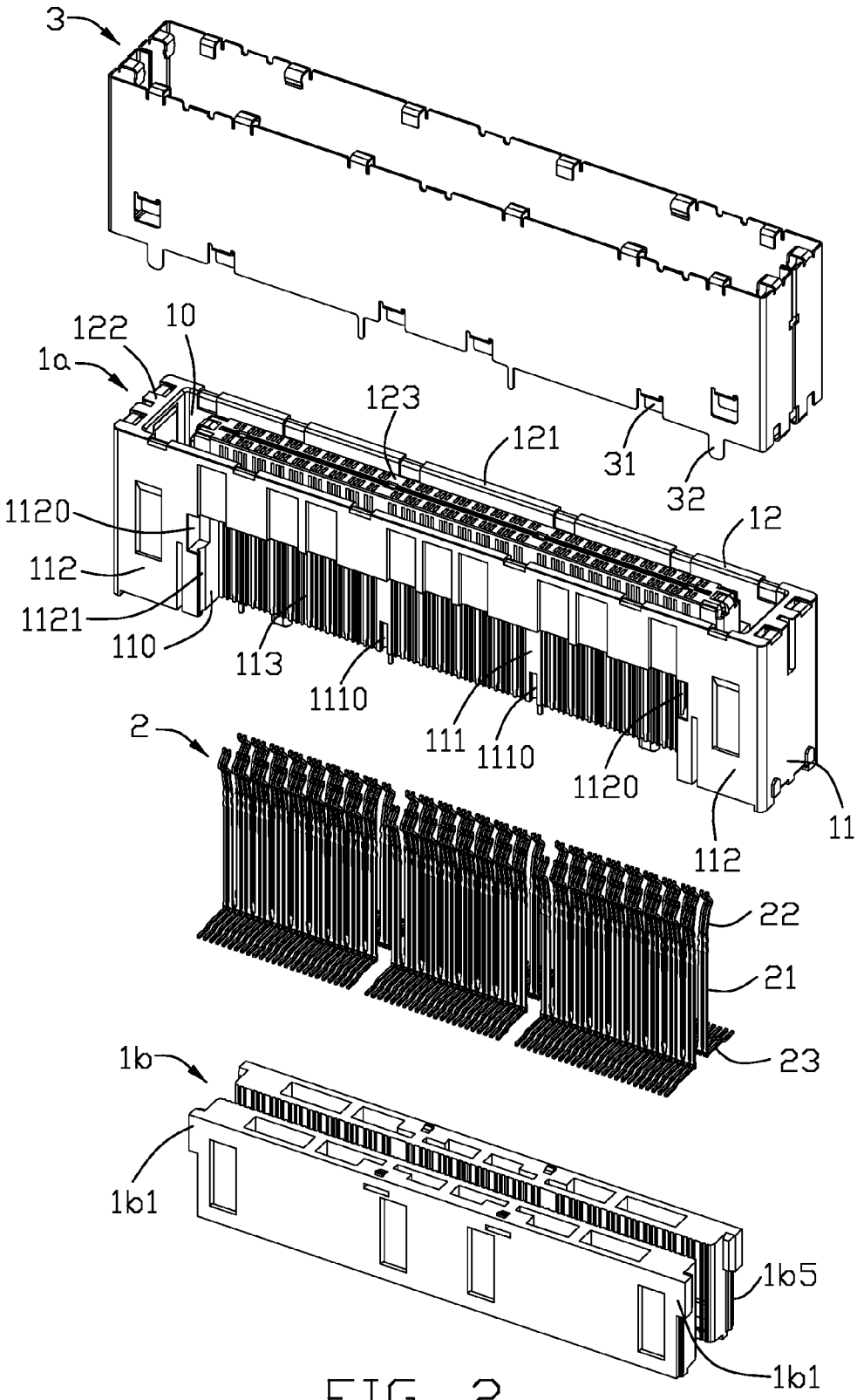
FIG. 2 is an exploded perspective view of the electrical connector of FIG. 1.

Referring to FIGS. 1 and 2, an electrical connector in accordance with the present invention includes an insulative housing 1*a* including a pair of retaining spacers 1*b* embedded therein, a plurality of terminals 2 retained in the insulative housing, a metallic shell 3 shielding the insulative housing.

Referring to FIG. 2, the insulative housing 1*a* is provided with a longitudinal base portion 11 and an engaging portion 12 upwardly extending from the base portion in a vertical direction perpendicular to a longitudinal direction of the housing. The engaging portion 12 has a pair of longitudinal side walls 121, a pair of end walls 122 integrally connecting with the side walls and a tongue portion 123 parallel to said two side walls, thereby forming a receiving space 10 for receiving a mating element. A plurality of grooves 113 extend upwards from a bottom of the base portion to the tongue portion 123. Combination with FIG. 5, the terminal 2 includes a long retaining portion 21 retained in the grooves of the base portion, an arc contacting portion 22 upwards extending into the receiving space 10 along the tongue portion and soldering portion 23 downwardly extending. The grooves 113 has widen dimension in a traverse direction perpendicular to the tongue portion so as to allow the arc contacting portion to be inserted along the vertical direction.

The base portion 11 includes two concaving rooms 110, a middle portion 111 between the two concaving rooms and a pair of end portions 112 along the longitudinal direction at each side thereof. The middle portion 111 corresponds to the terminals 2. The grooves 113 extend to the middle portion and open to the concaving rooms 110, i.e. part of the retaining portions of the terminals expose to the concaving rooms 110.

Referring to FIG. 2, the end portions 112 include a pair of openings 1120 opening to the concaving room 110 and outward and a pair of slits 1121 extending downwards from the opening 1120. Combination with FIGS. 3, 4 and 6, the pair of retaining spacers 1*b* is cuboid-shaped and inserted into the concaving rooms 110 along the traverse direction. The retaining spacer 1*b* has a pair of protruding portions 1*b*1 at opposite ends thereof, which are inserted into the openings 1120 for preventing the retaining spacers from detaching from the insulative housing downwardly. The retaining spacer 1*b* includes a pair of rib portions 1*b*5 at opposite ends thereof and below the protruding portion, which is received in and locked with the slits 1121 for preventing the retaining spacers from being detached from the end portion along the traverse direction. The retaining spacer further defines a plurality of positioning posts 1*b*4 at inner faces thereof, which are received and interfered with corresponding holes 1110 on the middle portion for improving retaining force between of the retaining spacers and the insulative housing.

Figure 3:
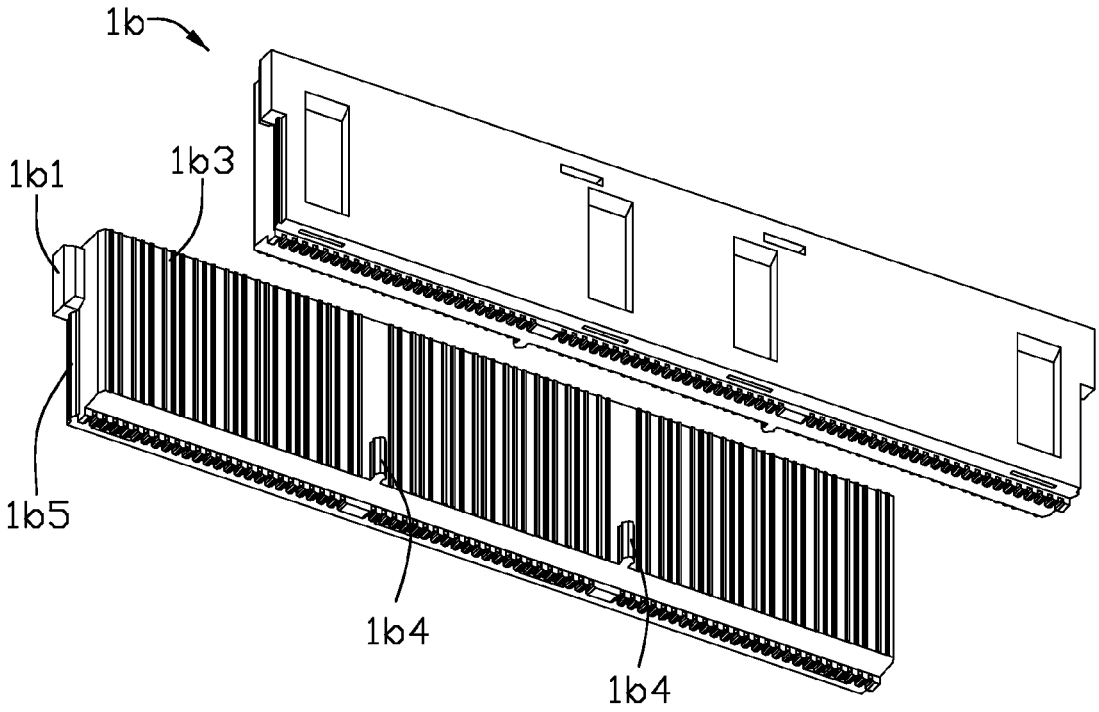
FIG. 3 is a perspective view of retaining spacers of the electrical connector of FIG. 2.
Figure 4:
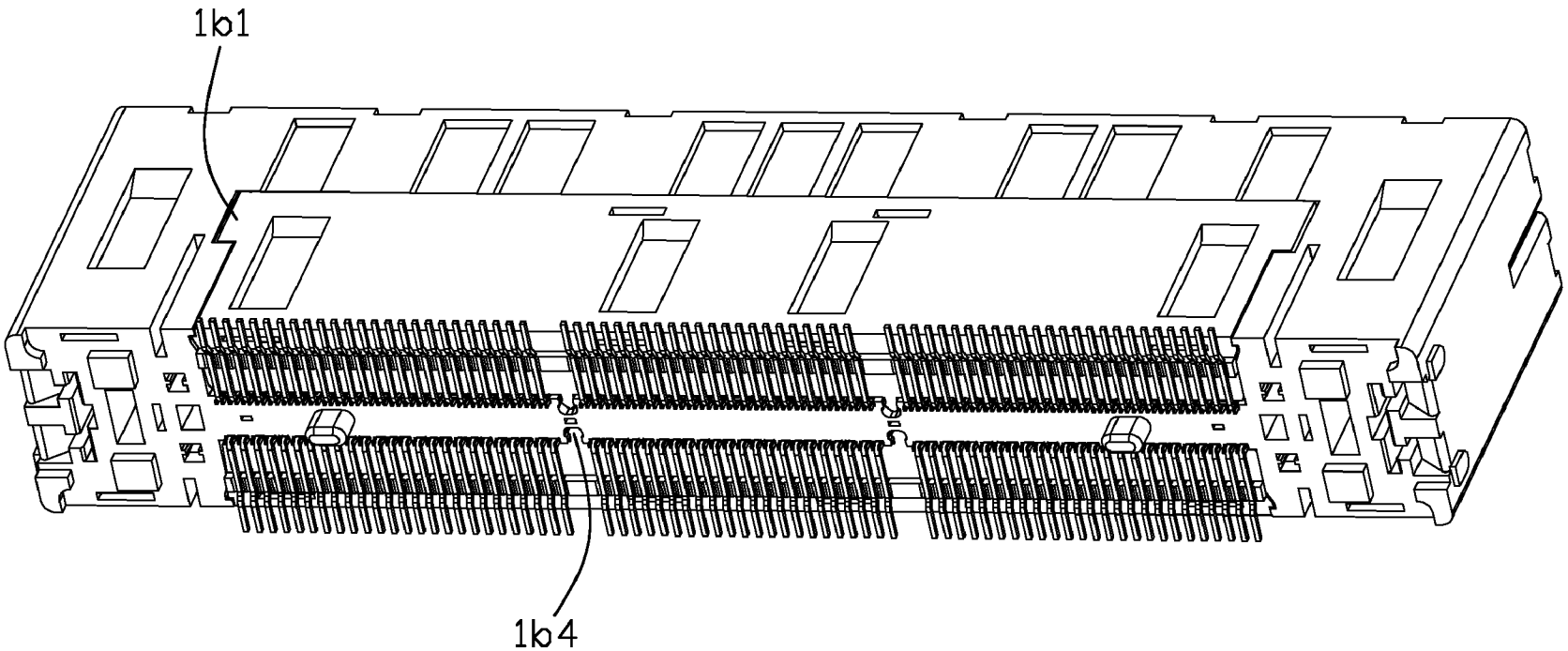
FIG. 4 is a perspective view of the electrical connector of FIG. 1 viewed from a bottom view without the shell.
Figure 5:
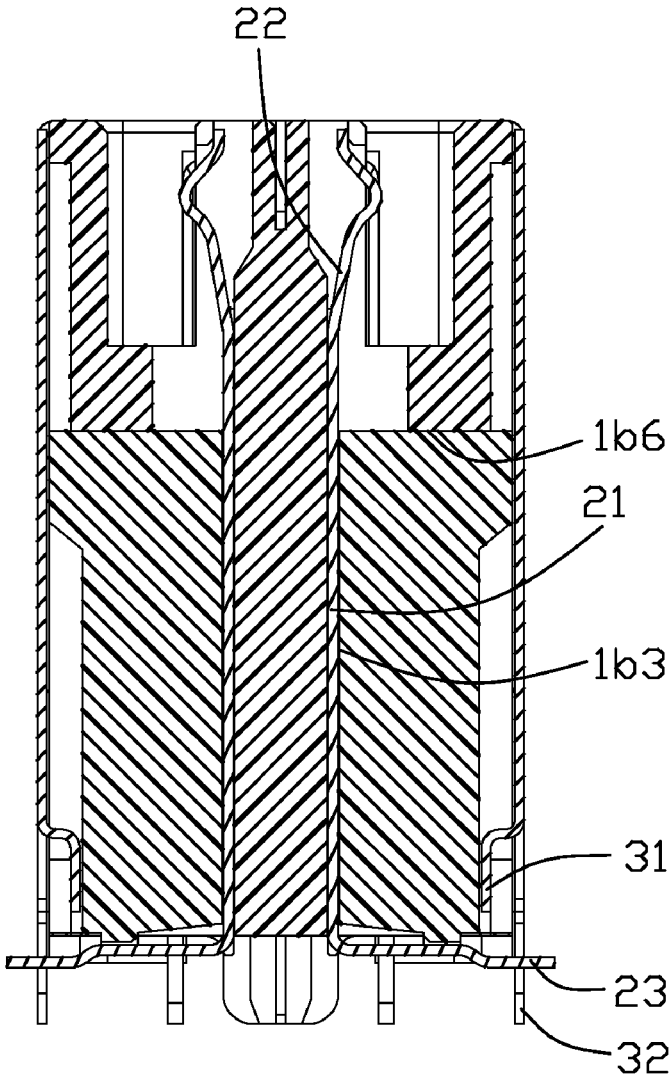
FIG. 5 is a cross-section view of the electrical connector taken along line 5-5 of FIG. 1.
Figure 6:
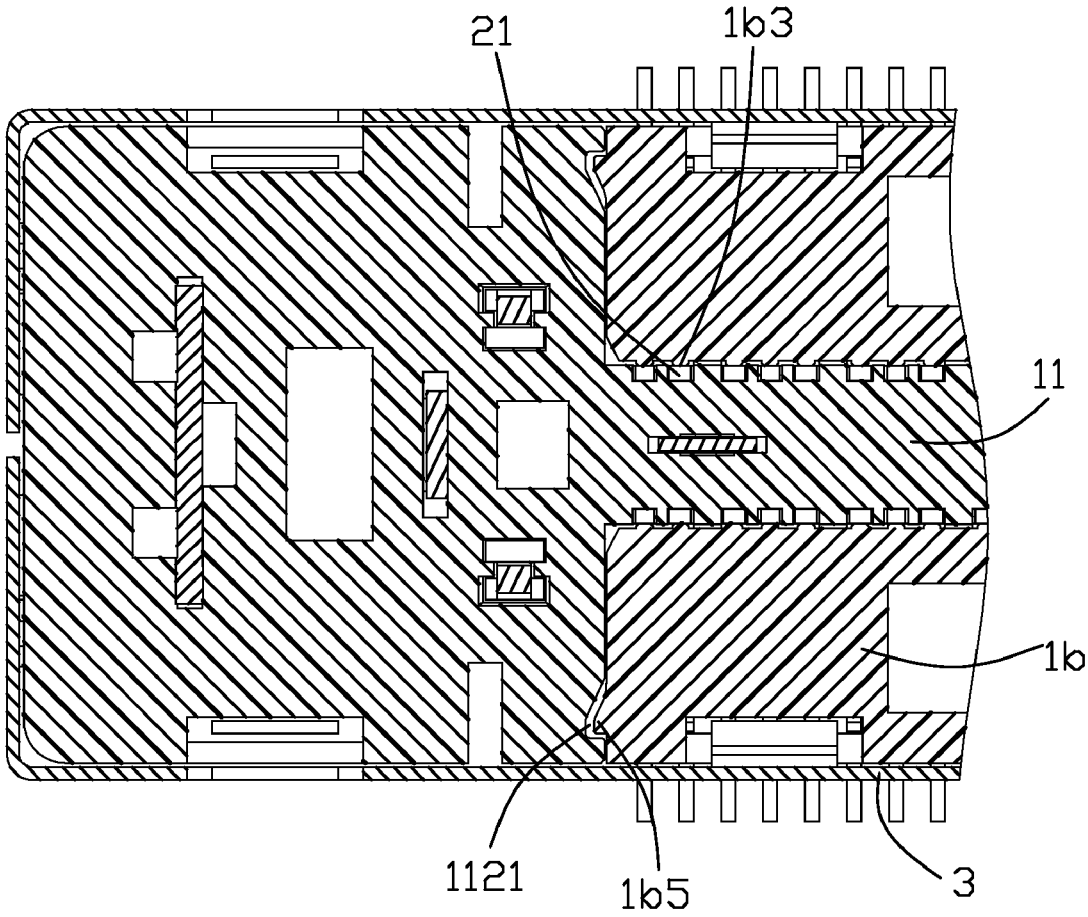
FIG. 6 is a partial cross-section view of the electrical connector taken along line 6-6 of FIG. 1.

Referring to FIGS. 3, 5 and 6, the retaining spacers 1*b* have a plurality of ribs 1*b*3 pressing against the retaining portion 21 of the terminals in the grooves for preventing the terminals from traverse movement. The retaining spacer includes a top surface 1*b*6 abutting against the roof face of the concaving room 110. The ribs of the retaining spacers are wedge-shaped.

The metallic shell 3 cover an outside of the base portion and the retaining spacers 1*b*. The shell defines a plurality of retaining tails 31 inserted into the retaining spacers and a plurality of soldering legs 32 for electrical connecting with grounding trace of a PCB (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising: an insulative housing comprising a base portion and an engaging portion extending from the base portion; a plurality of terminals retained in the insulative housing; a plurality of grooves extending from the base portion to the engaging portion to receive the terminals; wherein the base portion comprise two concaving rooms and a middle portion between the two concaving rooms, the grooves extend to the middle portion and open to the concaving rooms, the electrical connector comprises a pair of retaining spacers received and retained in the concaving rooms and comprising a plurality of ribs to press against the terminals, wherein the ribs of the retaining spacers are wedge-shaped, wherein the retaining spacer comprises a top surface abutting against roof face of the concaving room, wherein the base portion comprises a pair of end portions along a longitudinal direction at each side thereof, wherein the retaining spacer comprises a pair of wedge-shaped blocking portions at opposite ends thereof, the end portions comprise a pair of slits correspondingly receiving and locking with the blocking portions.

2. The electrical connector as described in claim 1, wherein the retaining spacer is cuboid-shaped.

3. The electrical connector as described in claim 1, wherein the end portions comprise a pair of openings at opposite ends thereof to receive a pair of protruding portions of the retaining spacer.

4. The electrical connector as described in claim 1, wherein the retaining spacer comprises a plurality of positioning posts, each of the positioning posts is received and interfered with a hole concaved in the middle portion.

5. The electrical connector as described in claim 1, wherein the electrical connector comprises a shell shielding the insulative housing and the retaining spacers.

6. An electrical connector comprising: a plurality of terminals, each comprising a retaining portion, a contacting portion and a leg portion; an insulating housing loaded the terminals and comprising a base portion and an engaging portion, the retaining portions of the terminals retained in the base portion and the contacting portions of the terminals projecting in the engaging portion, the base portion comprising an concaving room; a retaining spacer received in the concaving room; wherein the retaining spacer pressed against the retaining portions of the terminals, wherein the retaining portions of the terminals expose to concaving room, wherein the spacer is inserted into the concaving room in a direction perpendicular to the retaining portions.

7. An electrical connector comprising: an upstanding insulative housing including a base portion and a pair of opposite longitudinal side walls extending along a longitudinal direction, and a pair of end walls extending along a transverse direction perpendicular to said longitudinal direction, said side walls and said end walls commonly defining an upward receiving space with a tongue portion extending in a middle region of the receiving space; a plurality of terminals position upon two opposite surfaces of the tongue portion with tail portions located around a bottom face of the housing; a pair of concaving rooms formed in two longitudinal sides of the base portion under the corresponding side walls, respectively; and a pair of retaining spacers assembled within the corresponding concaving rooms so as to cooperate with the base portion to restrain the terminals therebetween in said transverse direction, wherein a metallic shield engages and encloses all said side walls, said end walls and said retaining spacers, wherein said base portion and said retaining spacer are configured to have said retaining spacer assembled into the corresponding concaving room in the transverse direction, respectively.

8. The electrical connector as claimed in claim 7, wherein said tail portions extend horizontally under the corresponding retaining spacer.

9. The electrical connector as claimed in claim 8, wherein the housing and the retaining spacers are configured to have the said terminals completely formed and assembled to the housing before the retaining spacer is assembled to the corresponding concaving room.

10. The electrical connector as claimed in claim 7, wherein the retaining spacer cooperates with the base portion to tightly sandwich the corresponding terminals therebetween in said transverse direction.

* * * * *